US005395294A

United States Patent [19]

Clem

[11] Patent Number: 5,395,294

[45] Date of Patent: Mar. 7, 1995

[54] FOOT PAD FOR STAIR CLIMBER EXERCISER

[75] Inventor: William E. Clem, Bozeman, Mont.

[73] Assignee: Tunturi, Inc., Redmond, Wash.

[21] Appl. No.: 181,775

[22] Filed: Jan. 18, 1994

[51] Int. Cl.[6] ..... A63B 22/04

[52] U.S. Cl. ..... 482/52; 482/79

[58] Field of Search ..... 482/51, 52, 53, 79, 482/80, 123, 57, 148, 74, 77

[56] References Cited

U.S. PATENT DOCUMENTS

| | | | |
|---|---|---|---|
| 1,509,793 | 9/1924 | Thompson | 482/79 |
| 1,977,415 | 10/1934 | Thorp | 482/79 |
| 3,472,508 | 10/1969 | Baker et al. | 482/79 |
| 4,830,362 | 5/1989 | Bull . | |
| 4,982,958 | 1/1991 | Ullman | 482/123 |
| 5,127,892 | 7/1992 | Sawdon | 482/79 |
| 5,129,872 | 7/1992 | Dalton et al. . | |
| 5,232,419 | 8/1993 | Kozak | 482/52 |
| 5,246,410 | 9/1993 | Fun . | |

*Primary Examiner*—Stephen R. Crow

*Attorney, Agent, or Firm*—Graybeal Jackson Haley & Johnson

[57] ABSTRACT

A foot pad for a stair climber type exerciser having a relatively soft cushioning pad overlying a rigid base member. The pad has a length of at least about one foot, a width of at least about four inches, and an undulating contoured surface extending from about one-quarter to at least about two-thirds of the way from the front to the rear of the pad. It also has an overall top surface convexity fore-and-aft enabling easier weight shift, from the user's heel to the ball of the foot as the attitude of the pedal changes during cyclical pivotal movement of the part of apparatus on which the foot pad is mounted. The cushioning pad disclosed is formed of molded polyvinylchloride with a hardness of about Durometer 70 Shore A.

6 Claims, 1 Drawing Sheet

FOOT PAD FOR STAIR CLIMBER EXERCISER

FIELD OF THE INVENTION

The present invention relates to foot pads or pedals for exercise apparatus and more particularly to improved foot pads for stair climber type exercise apparatus involving cyclical pivotal movement of the apparatus pedals and consequent cyclical pivotal movement of a user's feet while engaged with the pedals.

DESCRIPTION OF THE PRIOR ART

Stair climber type exercisers typically involve pivotally movable beams with pedals which are engaged by the feet of the user while standing on the bedims and moving the beams cyclically up and down in a more or less vertical manner, usually in alternating fashion, with the pads engaged by the feet of the user conventionally being simply flat, i.e. planar, in nature. Typical such stair climber exercise apparatus are shown in Bull U.S. Pat. Nos. 4,830,362, and Dalton et al U.S. Pat. No. 5,129,872, for example.

The flatness of the conventional foot pads and the cyclical pivotal movement of the user's feet when following the pads during their up and down movement have resulted in many dedicated stair climber users complaining of parathesia of the foot or "stair climber foot", which is said to occur as a result of constant pressure on the deep peroneal nerve.

A related problem encountered by consistent stair-climber users is a result of the fact that many stair climber foot pads are relatively narrow which forces users with wider than normal hips to somewhat force foot placement in an unnaturally narrow area. Although relatively wide foot pads with a cupped shaped toe area are to an extent already known, as in Fun U.S. Pat. No. 5,246,410, such foot pads still suffer the disadvantage of being essentially completely flat and rigid.

SUMMARY OF THE INVENTION

It is an object and feature of the present invention to provide stair climber exerciser foot pads or pedals of a cushioned, contoured nature to minimize the "stair climber foot" problems heretofore encountered and more particularly to provide such improved pads or pedals which have a top surface convexity allowing for easier weight shift from the user's heel to the ball of the foot as the attitude of the pad or pedal changes during cyclical pivotal movement of the apparatus on which the foot pad is mounted. This further provides increased comfort during extended use of stair climber type apparatus by providing in its foot pads or pedals laterally extending undulating contoured surfaces which increase movement and blood flow in the areas of the foot engaging the pad or pedal, and to also provide in such configuration a cushioned foot pads or pedal of yieldable, flexible molded plastic, and in particular this regard a foot pad or pedal formed of molded polyvinylchloride with a hardness of about Durometer 70 Shore A.

As a further object and feature of foot pads or pedals according to the present invention, such are configured to be relatively wide, i.e. at least about four inches in width, preferably with a front portion with a cupped shaped toe area which aids in preventing the slippage of the exerciser's foot off of the foot pad or pedal.

A further object and feature of the present invention is to provide an exerciser foot pad which has a rigid base member underlying a relatively soft cushioning pad including internal ribs of a relatively thin nature extending between the upper body portion of the pad and the rigid base member, such ribs being such as to yield dimensionally under the weight of the user and augment the flexural characteristics of the pad in use.

These and other objects, features and advantages of stairclimber type exerciser apparatus foot pads according to the present invention will appear from the following illustration and description of preferred forms thereof and as shown in the accompanying drawings.

DESCRIPTION OF THE PREFERRED EMBODIMENT

Figure 1:
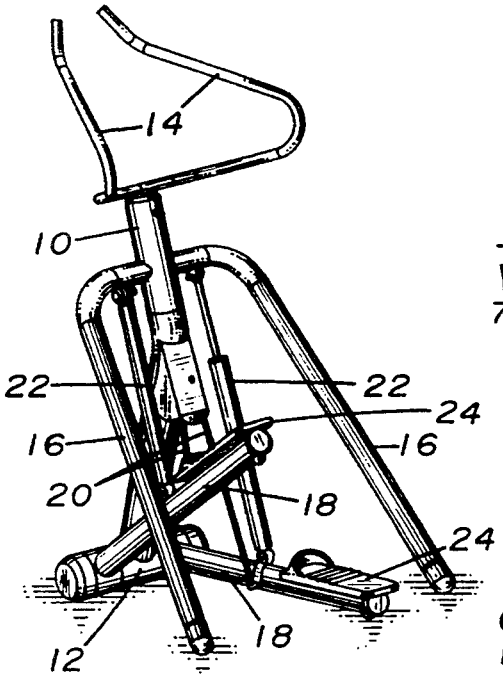
FIG. 1 is a typical stair climber apparatus incorporating an embodiment of foot pads or pedals according to the present invention.

FIG. 1 illustrates a typical stair climber representative of the type of exercise equipment on which foot pads or pedals according to the present invention have advantageous application. In general, this stair climber comprises a main upright 10 with a floor engaging lower end 12 and upwardly extending handlebars 14. Rearwardly extending legs 16 provide tripad-like support. Cyclically, and pivotally movable beams 18 are tied Together by cable means 20 passing over a pulley (not shown) so that the beams 18 can be moved alternately and oppositely up and down by the user, with resistance to such movement being supplied by respective fluid cylinders 22. In use, the user stands with his or her feet engaging the foot pads or pedals 24 on the ends of the beams 18, usually with the hands engaging the handlebars 14.

The present invention deals with the unique construction and features of the foot pads or pedals 24, as more fully shown and discussed in connection with FIGS. 2–7 which show one such foot pad. As used on the apparatus shown in FIG. 1, each foot pad 24 is identical to the other.

Figure 2:
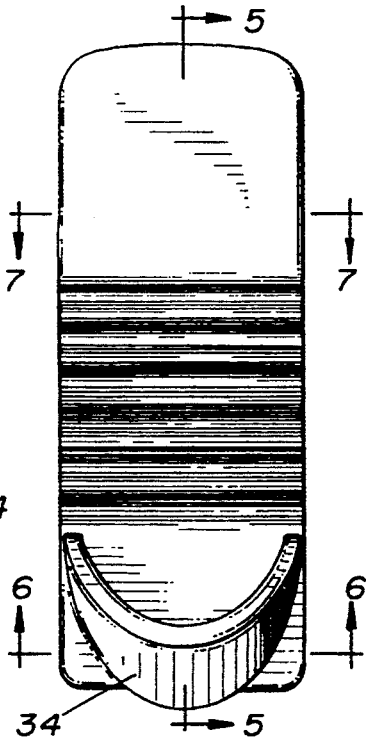
FIG. 2 is a top plan view of one of the foot pads shown on the apparatus in FIG. 1.
Figure 4:
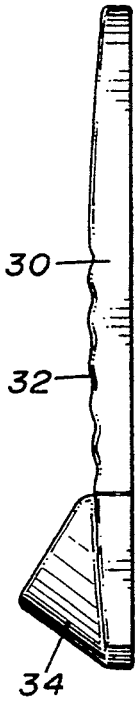
FIG. 4 is a side elevational view of the foot pad shown in FIGS. 2 and 3.
Figure 3:
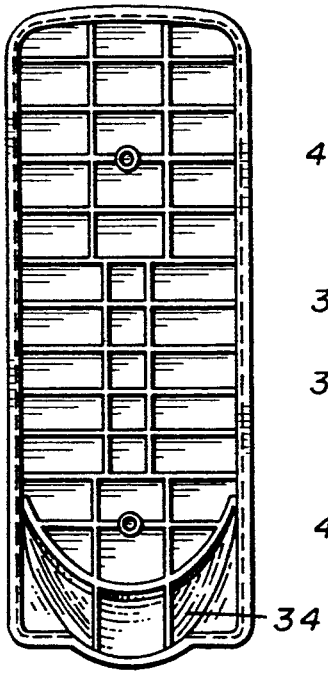
FIG. 3 is a bottom plan view, with the bottom plate removed, of the foot pad shown in FIG. 2.
Figure 5:
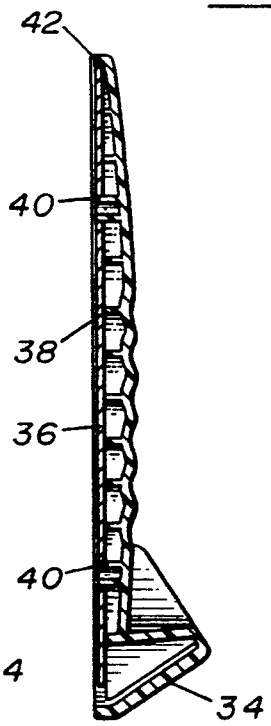
FIG. 5 is a cross sectional view of the foot pad shown in FIGS. 2–4, taken substantially along line 5—5 of FIG. 2.

As earlier indicated, the foot pads or pedals of the present invention are advantageous in minimizing so-called "stair climber" problems, being fabricated of relatively soft cushioning material and having a top surface convexity and an undulating contoured surface which increases movement and blood flow in the area of the foot engaging the pad or pedal. It is also characteristic that the pad or pedal is relatively wide, i.e. at least about 4 inches in width, preferably with a front portion having a cupped shaped toe receiving part do aid in preventing slippage of the foot off the pad or pedal. More particularly, as shown in FIGS. 2–7, each pad or pedal 24 is formed of molded polyvinylchloride to have a convex top surface 30 including laterally extending undulations 32 in the area from about one-quarter to about two-thirds of the way from the front to the rear of the pad (as shown in FIGS. 2, 4 and 5) and with a cup configuration at the forward or front end 34. The pad when fully assembled includes a thin essentially planar flat metal base plate 36 (shown in FIGS. 5, 6 and 7) and the molded plastic portion of the pad includes both longitudinally and laterally extending internal ribs, certain of which are indicated at 38 in FIGS. 3 and 5, of a relatively thin nature, such ribs being, such as to yield dimensionally under the pressure of the user's foot engaging the top surface of the pad, to augment the flexural characteristic of the pad in use.

It has been found that the desired cushioning and flexural characteristic of the molded portion of the pad is achieved by molding thereof from polyvinylchloride with a hardness of about Durometer 70 Shore A.

Figure 6:
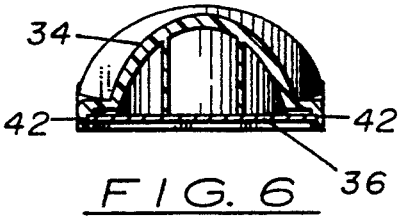
FIG. 6 is a cross sectional view of the foot pad shown in FIGS. 2–5, taken substantially along line 6—6 of FIG. 2.
Figure 7:
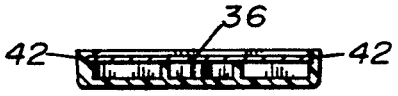
FIG. 7 is a cross sectional view of the foot pad shown in FIGS. 2–6, taken substantially along line 7—7 of FIG. 2.

The pads are suitably attached to the beams of a stair climber exerciser such as shown in FIG. 1 by first mounting just the metal plates 36 on the respective beams as by bolts, not shown, applied through bolt holes provided in the metal plate 36 such as shown at 40 in FIG. 6. Then, the molded plastic portion of the pad is placed on the metal plate 36 with an internally facing slotted recess around the edge of the plastic pad being deformed enough to slip over and firmly engage the edge of the metal plate 36, which internal edge recess is shown for example in FIGS. 5, 6 and 7 at 42.

Dimensionally, it is typical and satisfactory for the overall fore-and-aft convexity of the top surface of the pad to have a radius of curvature of 1.5 meters. By way of typical illustration, the overall thickness of the molded portion of the illustrated pad including the top surface thereof is 3.9 millimeters and the thickness of the internal ribs 38 extending between it and the metal plate is 2.65 millimeters.

In view of the foregoing, further variations and modifications of exerciser foot pads according to the invention will occur to those skilled in the art to which the invention is addressed, within the scope of the following claims.

What is claimed is:

1. A foot pad for a stairclimber type exercise apparatus, said foot pad comprising a rigid base member underlying a relatively soft cushioning pad, said relatively soft cushioning pad including internal ribs of a relatively thin nature extending between the upper body portion of the soft cushioning pad and engaging at the lower extremities thereof the rigid base member, said internal ribs being such as to yield dimensionally under the weight of the user and augment the flexural characteristic of the pad in use.

2. A foot pad according to claim 1, wherein the top surface of said foot pad has an overall fore-and-aft convexity.

3. A foot pad according to claim 2, wherein the top surface of said foot pad comprises laterally extending undulations arranged at least from about one-quarter to about two-thirds of the way from the front to the rear of the pad and extending completely across the pad in a generally sinusoidal configuration considered cross-sectionally longitudinally of the pad.

4. A foot pad according to claim 3, wherein said foot pad comprises molded polyvinylchloride with a hardness of about Durometer 70 Shore A.

5. A foot pad according to claim 1, wherein said foot pad comprises molded polyvinylchloride with a hardness of about Durometer 70 Shore A.

6. A foot pad for a stairclimber type exercise apparatus, comprising a rigid base member and a relatively soft cushioning pad overlying said base member, said cushioning pad having a length of at least about one foot and a width of at least about four inches, said relatively soft cushioning pad including internal ribs of a relatively thin nature extending between the upper body portion of the soft cushioning pad and engaging at the lower extremities thereof the rigid base member, such ribs being such as to yield dimensionally under the weight of the user and augment the flexural characteristic of the pad in use, said pad further having an overall fore-and-aft top surface convexity allowing for easier weight shift from the user's heel to the ball of the foot as the attitude of the pedal changes during cyclical pivotal movement of the apparatus on which the foot pad is mounted.

* * * * *